United States Patent [19]

McWhirter

[11] Patent Number: 4,688,187

[45] Date of Patent: Aug. 18, 1987

[54] CONSTRAINT APPLICATION PROCESSOR FOR APPLYING A CONSTRAINT TO A SET OF SIGNALS

[75] Inventor: John G. McWhirter, Malvern Wells, England

[73] Assignee: Secretary of State for Defence in Her Britannic Majesty's Government of the United Kingdom of Great Britain and Northern Ireland, London, England

[21] Appl. No.: 627,625

[22] Filed: Jul. 3, 1984

[30] Foreign Application Priority Data

Jul. 6, 1983 [GB] United Kingdom ..... 8318333
Jul. 6, 1983 [GB] United Kingdom ..... 8318269

[51] Int. Cl.[4] ..... G06G 7/00; H01Q 3/26

[52] U.S. Cl. ..... 364/825; 364/807; 342/381; 342/384

[58] Field of Search ..... 364/807, 819–821, 364/825, 602; 367/6, 21–22, 38, 43, 117, 153; 343/700 MS, 703, 720, 722, 745, 751, 756, 824–825, 853, 865, 379–384

[56] References Cited

U.S. PATENT DOCUMENTS

| | | | |
|---|---|---|---|
| 3,876,947 | 4/1975 | Giraudon | 343/384 X |
| 3,978,483 | 8/1976 | Lewis et al. | 343/381 X |
| 4,075,633 | 2/1978 | Lewis | 343/381 X |
| 4,129,873 | 12/1978 | Kennedy | 343/854 |
| 4,236,158 | 11/1980 | Daniel | 343/380 X |
| 4,268,829 | 5/1981 | Baurle et al. | 343/381 X |
| 4,280,128 | 7/1981 | Masak | 343/381 X |
| 4,555,706 | 11/1985 | Haupt | 343/379 |

FOREIGN PATENT DOCUMENTS 2151378 7/1985 United Kingdom .

OTHER PUBLICATIONS

IEEE Transactions on Aerospace and Electronic Systems, vol. 19, No. 1, Jan. 1983, pp. 30–39, "Steered Beam and LMS Interference Canceler Comparison".
IEEE Transactions on Antennas and Propagation, vol. AP-24, No. 5, Sep. 1976, pp. 650–662, Applebaum et al., "Adaptive Arrays with Main Beam Constraints".
Proceedings of the IEEE, vol. 60, No. 8, Aug. 1972, pp. 926–935, O. L. Frost: "An Algorithm for Linearly Constrained Adaptive Array Processing".
IEEE Transactions on Antennas and Propagation, vol. AP-24, No. 5, Sep. 1976, pp. 585–598, S. P. Applebaum: "Adaptive Arrays".
Proceedings of the IEEE, vol. 55, No. 12, Dec. 1967, pp. 2143–2159, B. Widrow et al., "Adaptive Antenna Systems".
IEEE Transactions on Aerospace and Electronic Systems, vol. AES-10, Nov. 1974, pp. 853–863, I. S. Reed et al., "Rapid Convergence Rate in Adaptive Arrays".
"Matrix Triangularization by Systolic Arrays", [Preliminary Version], W. M. Gentlemen, Dept. of Computer Science, Ontario, Canada, and H. T. Kung, Dept. of Computer Science, Pennsylvania, USA; 1981.

*Primary Examiner*—Gary V. Harkcom
*Attorney, Agent, or Firm*—Cushman, Darby & Cushman

[57] ABSTRACT

A constraint application processor is arranged to apply a linear constraint to signals from antennas. A main antenna signal is fed to constraint element multipliers and then to respective adders for subtraction from subsidiary antenna signals. Delay units delay the subsidiary signals by one clock cycle prior to subtraction. The main signal is also fed via a one cycle delay unit to a multiplier for amplification by a gain factor. Main and subsidiary outputs of the processor may be connected to an output processor for signal minimization subject to the main gain factor remaining constant. The output processor may be arranged to produce recursive signal residuals in accordance with the Widrow LMS (Least Mean Square) algorithm. This requires a processor arranged to sum main and weighted subsidiary signals, weight factors being derived from preceding data, residual and weight factors. Alternatively, a systolic array of processing cells may be employed.

9 Claims, 4 Drawing Figures

$31_1$
$31_2$
$31_p$
$31_{p+1}$
30
$x_1(n+1)$
$x_2(n+1)$
$x_p(n+1)$
$y(n+1)$
$x_1(n)$
$2Ke(n)$
$46_1$
$44_1$
$x_2(n)$
$46_2$
$44_2$
$x_p(n)$
$46_p$
$44_p$
$x_3(n+1)$
$54_1$
$W_1(n)$
$36_1$
$W_1(n+1)$
37
$56_1$
$54_2$
$W_2(n)$
$W_2(n+1)$
$36_2$
$56_2$
$54_p$
$W_p(n)$
$W_p(n+1)$
$36_p$
$56_p$
$58_p$
$58_2$
$58_1$
5
38
32
52
e(n)
2K
50
42
2Ke(n)

CONSTRAINT APPLICATION PROCESSOR FOR APPLYING A CONSTRAINT TO A SET OF SIGNALS

BACKGROUND OF THE INVENTION

This invention relates to a constraint application processor, of the kind employed to apply linear constraints to signals obtained in parallel from multiple sources such as arrays of radar antennas or sonar transducers.

Constraint application processing is known, as set out for example by Applebaum (Reference $A_1$) at page 136 of "Array Processing Applications to Radar", edited by Simon Haykin, published by Hughes, Dowden Hutchinson and Ross Inc. 1980. Reference $A_1$ describes the case of adaptive sidelobe cancellation in radar, in which the constraint is that one (main) antenna has a fixed gain, and the other (subsidiary) antennas are unconstrained. This simple constraint has the form $\underline{W}^T\underline{C}=\mu$, where the transpose of $\underline{C}$ is $\underline{C}^T$, the row vector [0, 0, . . . 1], $\underline{W}^T$ is the transpose of a weight vector $\underline{W}$ and $\mu$ is a constant. For many purposes, this simple constraint is inadequate, it being advantageous to apply a constraint over all antenna signals from an array.

A number of schemes have been proposed to extend constraint application to include a more general constraint vector $\underline{C}$ not restricted to only one non-zero element.

In Reference $A_1$, Applebaum also describes a method for applying a general constraint vector for adaptive beamforming in radar. Beam-forming is carried out using an analog cancellation loop in each signal channel. The $k^{th}$ element $C_k$ of the constraint vector $\underline{C}$ is simply added to the output of the $k^{th}$ correlator, which, in effect defines the $k^{th}$ weighting coefficient $W_k$ for the $k^{th}$ signal channel. However, the technique is only approximate, and can lead to problems of loop instability and system control difficulties.

In Widrow et al (Reference $A_2$), at page 175 of "Array Processing Applications to Radar" (cited earlier), the approach is to construct an explicit weight vector incorporating the constraint to be applied to array signals. The Widrow LMS (least mean square) algorithm is employed to determine the weight vector, and a so-called pilot signal is used to incorporate the constraint. The pilot signal is generated separately. It is equal to the signal generated by the array in the absence of noise and in response to a signal of the required spectral characteristics received by the array from the appropriate constraint direction. The pilot signal is then treated as that received from a main fixed gain antenna in a simple sidelobe cancellation configuration. However, generation of a suitable pilot signal is very inconvenient to implement. Moreover, the approach is only approximate; convergence corresponds to a limit never achieved in practice. Accordingly, the constraint is never satisfied exactly.

Use of a properly constrained LMS algorithm has also been proposed by Frost (Reference $A_3$), at page 238 of "Array Processing Applications to Radar" (cited earlier). This imposes the required linear constraint exactly, but signal processing is a very complex procedure. Not only must the weight vector be updated according to the basic LMS algorithm every sample time, but it must also be multiplied by the matrix $P=I-\underline{C}(\underline{C}^T\underline{C})^{-1}\underline{C}^T$, and added to the vector $\underline{F}=\mu\underline{C}(\underline{C}^T\underline{C})$. Here I is the unit diagonal matrix, $\underline{C}$ the constraint vector and T the conventional symbol indicating vector transposition.

A further discussion on the application of constraints in adaptive antenna arrays is given by Applebaum and Chapman (Reference $A_4$), at page 262 of "Array Processing Applications to Radar" (cited earlier).

It has been proposed to apply beam constraints in conjunction with direct solution algorithms, as opposed to gradient or feedback algorithms. This is set out in Reed et al (Reference $A_5$), at page 322 of "Array Processing Applications to Radar" (cited earlier), and makes use of the expression:

$$M\underline{W}=\underline{C}^*, \text{ where } \underline{C}^* \text{ is the complex conjugate of } \underline{C}. \quad (1)$$

Equation (1) relates the optimum weight vector $\underline{W}$ to the constraint vector $\underline{C}$ and the covariance matrix $\overline{M}$ of the received data. M is given by:

$$M=X^TX \quad (2)$$

where X is the matrix of received data or complex signal values, and $X^T$ is its transpose. Each instantaneous set of signals from an array of antennas or the like is treated as a vector, and successive sets of these signals or vectors form the matrix X. The covariance matrix M expresses the degree of correlation between, for example, signals from different antennas in an array. Equation (2) is derived analytically by the method of Langrangian undetermined multipliers. The direct application of equation (1) involves forming the covariance matrix M from the received data matrix X, and, since the constraint vector $\underline{C}$ is a known precondition, solving for the weight vector $\underline{W}$. This approach is numerically ill-conditioned, ie division by small and therefore inaccurate quantities may be involved, and a complicated electronic processor is required. For example, solving for the weight vector involves storing each element of the covariance matrix M, and retrieving it from or returning it to the appropriate storage location at the correct time. This is necessary in order to carry out the fixed sequence of arithmetic operations required for a given solution algorithm. This involves the provision of complicated circuitry to generate the correct sequence of instructions and addresses. It is also necessary to store the matrix of data X while the weight vector is being computed, and subsequently to apply the weight vector to each row of the data matrix in turn inorder to produce the required array residual.

Other direct methods of applying linear constraints, do not form the covariance matrix M, but operate directly on the data matrix X. In particular, the known modified Gram-Schmidt algorithm reduces X to a triangular matrix, thereby producing the inverse Cholesky square root factor G of the covariance matrix. The required linear constraint is then applied by invoking equation (2) appropriately. However, this leads to a cumbersome solution of the form $\underline{W}=G(S^*G)^T$, which involves computation of two successive matrix/vector products.

In "Matrix Triangularisation by Systolic Arrays", Proc. SPIE., Vol 28, Real-Time Signal Processing IV (1981) (Reference B), Kung and Gentleman employed systolic arrays to solve least squares problems, of the kind arising in adaptive beamforming. A QR decomposition of the data matrix is produced such that:

$$QX=[R/O] \quad (3)$$

where R is an upper triangular matrix. The decomposition is performed by a triangular systolic array of processing cells. When all data elements of X have passed through the array, parameters computed by and stored in the processing cells are routed to a linear systolic array. The linear array performs a back-substitution procedure to extract the required weight vector W corresponding to a simple constraint vector [0, 0, 0 . . . 1] as previously mentioned. However, the solution can be extended to include a general constraint vector $\underline{C}$. The triangular matrix R corresponds to the Cholesky square root factor of Reference B and so the optimum weight vector for a general constraint takes the form $R\underline{W}=Z$, where $R^T\underline{Z}=\underline{C}^*$. These can be solved by means of two successive triangular back-substitution operations using the linear systolic array referred to above. However the back-substitution process can be numerically ill-conditioned, and the need to use an additional linear systolic array is cumbersome. Furthermore, back-substitution produces a single weight vector $\underline{W}$ for a given data matrix X. It is not recursive as required in many signal processing applications, ie there is no means for updating $\underline{W}$ to reflect data added to X.

SUMMARY OF THE INVENTION

It is an object of the present invention to provide an alternative form of constraint application processor.

The present invention provides a constraint application processor including:

1. input means for accommodating a main input signal and a plurality of subsidiary input signals;
2. means for subtracting from each subsidiary input signal a product of a respective constraint coefficient with the main input signal to provide a subsidiary output signal; and
3. means for applying a gain factor to the main input signal to provide a main output signal.

The invention provides an elegantly simple and effective means for applying a linear constraint vector comprising constraint coefficients or elements to signals from an array of sources, such as a radar antenna array. The output of the processor of the invention is suitable for subsequent processing to provide a signal amplitude residual corresponding to minimisation of the array signals, with the proviso that the gain factor applied to the main input signal remains constant. This makes it possible inter alia to configure the signals from an antenna array such that diffraction nulls are obtained in the direction of unwanted or noise signals, but with the gain in a required look direction remaining constant.

The processor of the invention may conveniently include delaying means to synchronise signal output.

In a preferred embodiment, the invention includes an output processor arranged to provide signal amplitude residuals corresponding to minimisation of the input signals subject to the proviso that the main signal gain factor remains constant. The output processor may be arranged to operate in accordance with the Widrow LMS algorithm. In this case, the output processor may include means for weighting each subsidiary signal recursively with a weight factor equal to the sum of a preceding weight factor and the product of a convergence coefficient with a preceding residual. Alternatively, the output processor may comprise a systolic array of processing cells arranged to evaluate sine and cosine or equivalent rotation parameters from the subsidiary input signals and to apply them cumulatively to the main input signal. Such an output processor would also include means for deriving an output comprising the product of the cumulatively rotated main input signal with the product of all applied cosine rotation parameters.

The invention may comprise a plurality of constraint application processors arranged to apply a plurality of constaints to input signals.

BRIEF DESCRIPTION OF THE DRAWINGS

In order that the invention might be more fully understood, embodiments thereof will now be described, by way of example only, with reference to the accompanying drawings, in which.

DETAILED DESCRIPTION OF THE PRESENTLY PREFERRED EXEMPLARY EMBODIMENT

Figure 1:
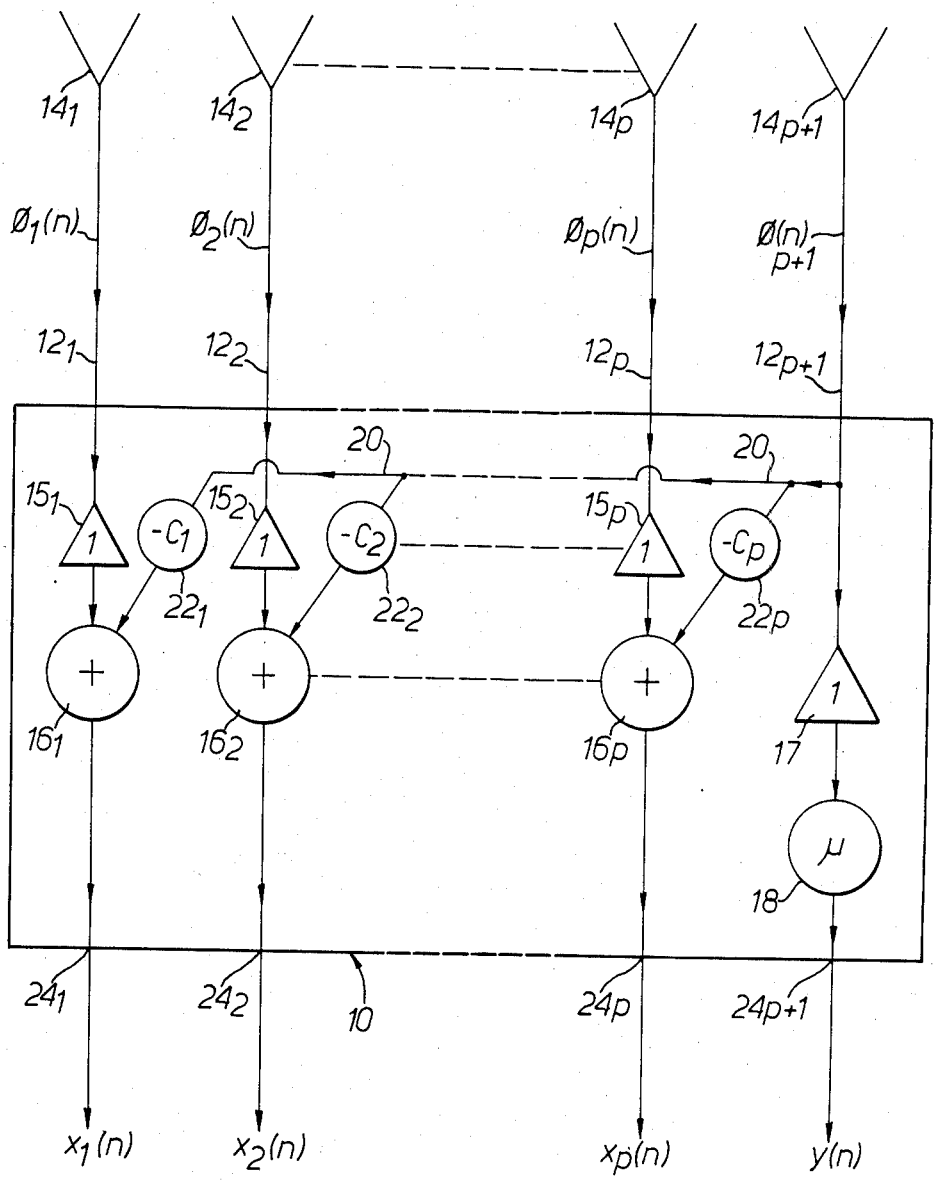
FIG. 1 is a schematic functional drawing of a constraint application processor of the invention.

Referring to FIG. 1, there is shown a schematic functional drawing of a constraint application processor 10 of the invention. The processor is connected by connections $\mathbf{12}_1$ to $\mathbf{12}_{p+1}$ to an array of (p+1) radar antennas $\mathbf{14}_1$ to $\mathbf{14}_{p+1}$ indicated conventionally by V symbols. Of the connections and antennas, only connections $\mathbf{12}_1$, $\mathbf{12}_2$, $\mathbf{12}_p$, $\mathbf{12}_{p+1}$ and corresponding antennas $\mathbf{14}_1$, $\mathbf{14}_2$, $\mathbf{14}_p$, $\mathbf{14}_{p+1}$ are shown, others and corresponding parts of the processor 10 being indicated by chain lines. Antenna $\mathbf{14}_{p+1}$ is designated the main antenna and antennas $\mathbf{14}_1$ to $\mathbf{14}_p$ the subsidiary antennas. The parameter p is used to indicate that the invention is applicable to an arbitrary number of antennas etc. The antennas $\mathbf{14}_1$ to $\mathbf{14}_{p+1}$ are associated with conventional heterodyne signal processing means and analog to digital converters (not shown). These provide real and imaginary digital components for each of the respective antenna output signals $\phi_1(n)$ to $\phi_{p+1}(n)$. The index n in parenthesis denotes the $n^{th}$ signal sample. The signals $\phi_1(n)$ to $\phi_p(n)$ from subsidiary antennas $\mathbf{14}_1$ to $\mathbf{14}_p$ are fed via one-cycle delay units $\mathbf{15}_1$ to $\mathbf{15}_p$ (shift registers) to respective adders $\mathbf{16}_1$ to $\mathbf{16}_p$ in the processor 10. Signal $\phi_{p+1}(n)$ from the main antenna is fed via a one-cycle delay unit 17 to a multiplier 18 for multiplication by a constant gain factor $\mu$. This signal also passes via a line 20 to multipliers $\mathbf{22}_1$ to $\mathbf{22}_p$. The multipliers $\mathbf{22}_1$ to $\mathbf{22}_p$ are connected to the adders $\mathbf{16}_1$ to $\mathbf{16}_p$, the latter supplying outputs at $\mathbf{24}_1$ to $\mathbf{24}_p$ respectively. Multiplier 18 supplies an output at $\mathbf{24}_{p+1}$.

The arrangement of FIG. 1 operates as follows. The antennas 14, delay units 15 and 17, adders 16, and multipliers 18 and 22 are under the control of a system clock (not shown). Each operates once per clock cycle. Each antenna provides a respective output signal $\phi_m(n)$ (m=1 to p+1) once per clock cycle to reach delay units 15 and 17. Each multiplier $\mathbf{22}_m$ multiplies $\phi_{p+1}(n)$ by its respective constraint coefficient $-C_m$, and outputs the result $-C_m\phi_{p+1}(n)$ to the respective adder $\mathbf{16}_m$. On the subsequent clock cycle, each adder $\mathbf{16}_m$ adds the respective input signals from the delay unit $\mathbf{15}_m$ and multiplier $\mathbf{22}_m$. This produces terms $x_1(n)$ to $x_p(n)$ at outputs $\mathbf{24}_1$ to $\mathbf{24}_p$ and y(n) at output $\mathbf{24}_{p+1}$. The output signals appear at outputs $24_1$ to $24_{p+1}$ in synchronism, since all signals have passed through two processing cells (multiplier, adder or delay) in the processor 10. The terms $x_1(n)$ to $x_p(n)$ are given by:

$$y(n)=\mu\phi_{p+1}(n) \tag{4.1}$$

and $$x_m(n)=\phi_m(n)-C_m\phi_{p+1}(n) \tag{4.2}$$

where m=1 to p.

Equation (4.1) expresses the transformation of the main antenna signal $\phi_{p+1}(n)$ to a signal y(n) weighted by a coefficient $W_{p+1}$ constrained to take the value $\mu$. Moreover, the subsidiary antenna signals $\phi_1(n)$ to $\phi_p(n)$ have been transformed as set out in equation (4.2) into signals $x_m(n)$ or $x_1(n)$ to $x_p(n)$ incorporating respective elements $C_1$ to $C_p$ of a constraint vector $\underline{C}$.

These signals are now suitable for processing in accordance with signal minimization algorithms. As will be described later in more detail, the invention provides signals $y_n(n)$ and $x_m(n)$ in a form appropriate to produce a signal amplitude residual e(n) when subsequently processed. The residual e(n) arises from minimization of the antenna signal amplitudes $\phi_1(n)$ to $\phi_{p+1}(n)$ subject to the constraint that the gain factor $\mu$ applied to the main antenna signal $\phi_{p+1}(n)$ remains constant. This makes it possible inter alia to process signals from an antenna array such that the gain in a given look direction is constant, and that antenna array gain nulls are produced in the directions of unwanted noise sources.

Figure 2:
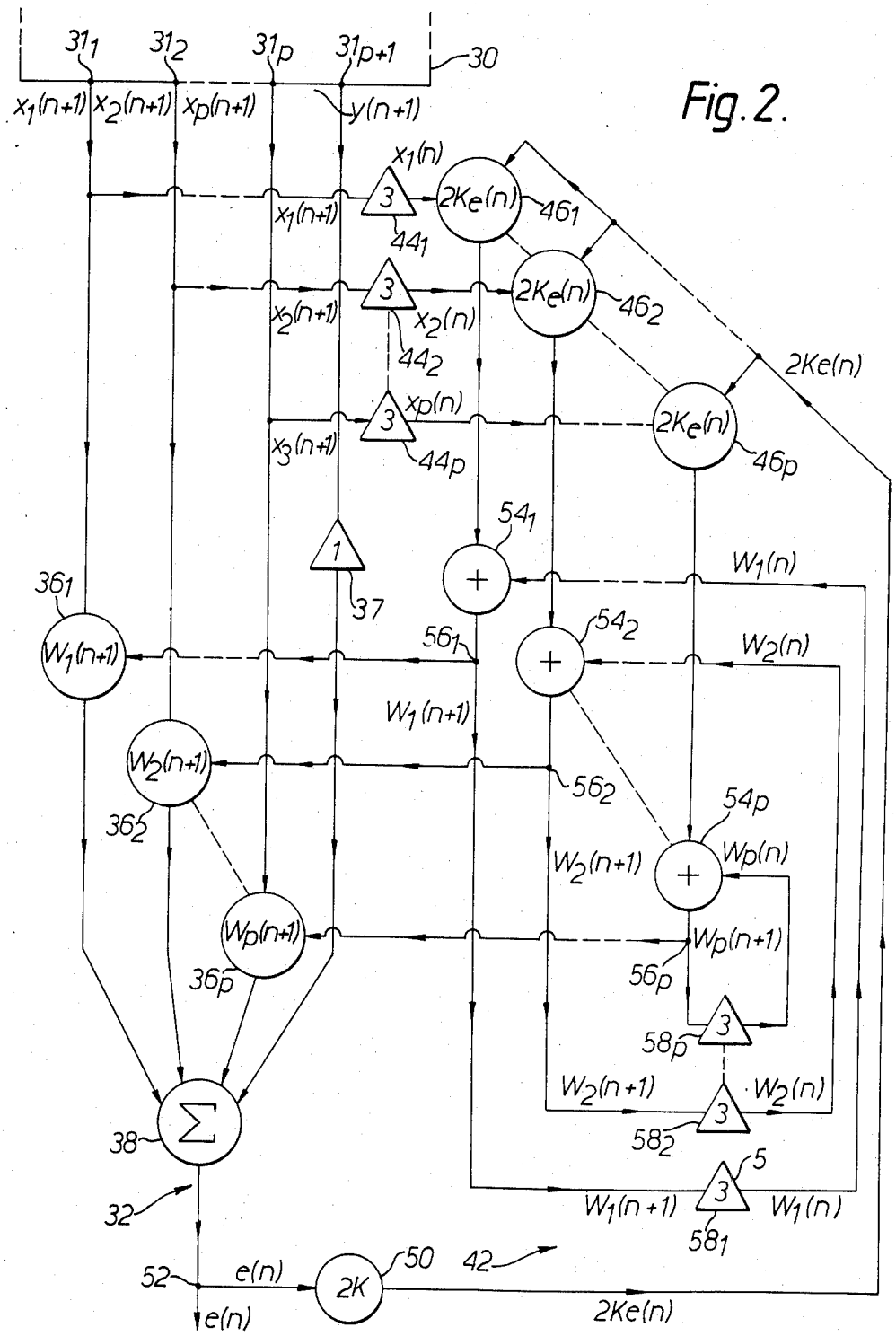
FIG. 2 is a schematic functional drawing of an output processor arranged to derive signal amplitude residuals.

Referring now to FIG. 2, there is shown a constraint application processor 30 of the invention as in FIG. 1 having outputs $31_1$ to $31_{p+1}$ connected to an output processor indicated generally by 32. The output processor 32 is arranged to produce the signal amplitude residual e(n). The output processor 32 is arranged to operate in accordance with the Widrow LMS (Least Mean Square) algorithm discussed in detail in Reference $A_2$.

The signals $x_1(n+1)$ to $x_p(n+1)$ pass from the processor 30 to respective multipliers $36_1$ to $36_p$ for multiplication by weight factors $W_1(n+1)$ to $W_p(n+1)$. A one-cycle delay unit 37 delays the main antenna signal y(n+1). A summer 38 sums the outputs of multipliers $36_1$ to $36_p$ with y(n+1). The result provides the signal amplitude residual e(n+1). The corresponding minimized power E(n+1) is given by squaring the modulus of e(n+1), ie $$E(n+1)=||e(n+1)||^2$$

It should be noted that e(n) is in fact shown in the drawing at output 52, corresponding to the preceding result. This is to clarify operation of a feedback loop indicated generally by 42 and producing weight factors $W_1(n+1)$ etc.

The processor output signals $x_1(n+1)$ to $x_p(n+1)$ are also fed to respective three-cycle delay units $44_1$ to $44_p$, and then to the inputs of respective multipliers $46_1$ to $46_p$. Each of the multipliers $46_1$ to $46_p$ has a second input connected to a multiplier 50, itself connected to the output 52 of the summer 38. The outputs of multipliers $46_1$ to $46_p$ are fed to respective adders $54_1$ to $54_p$. These adders have outputs $56_1$ to $56_p$ connected both to the weighting multipliers $36_1$ to $36_p$, and via respective three-cycle delay units $58_1$ to $58_p$ to their own second inputs.

As in FIG. 1, the parameter p subscript to reference numerals in FIG. 2 indicates the applicability of the invention to arbitrary numbers of signals, and missing elements are indicated by chain lines.

The FIG. 2 arrangement operates as follows. Each of its multipliers, delay units, adders and summers operates under the control of a clock (not shown) operating at three times the frequency of the FIG. 1 clock. The antennas $14_1$ to $14_{p+1}$ produce signals $\phi_1(n)$ to $\phi_{p+1}(n)$ every three cycles of the FIG. 2 system clock. The signals $x_1(n+1)$ to $x_p(n+1)$ are clocked into delay units $44_1$ to $44_p$ every three cycles. Simultaneously, the signals $x_1(n)$ to $x_p(n)$ obtained three cycles earlier are clocked out of delay units $44_1$ to $44_p$ and into multipliers $46_1$ to $46_p$. One cycle earlier, residual e(n) appeared at 52 for multiplication by 2k at 50. Accordingly, signal 2ke(n) subsequently reaches multipliers $46_1$ to $46_2$ as second inputs to produce outputs 2ke(n) $x_1(n)$ to 2ke(n) $x_p(n)$ respectively. These outputs pass to adders $54_1$ to $54_p$ for addition to weight factors $W_1(n)$ to $W_{p(n)}$ *calculated three cycles earlier. This produces updated weight factors* $W_1(n+1)$ to $W_p(n+1)$ for multiplying $x_1(n+1)$ to $x_p(n+1)$. This implements the Widrow LMS algorithm, the recursive expression for generating successive weight factors being:

$$W_m(n+1)=W_m(n)+2ke(n)x_m(n)(m=1 \text{ to } p) \tag{5}$$

where $W_m(1)=0$ as an initial condition.

As discussed in Reference $A_2$, the term 2k is a factor chosen to ensure convergence of e(n), a sufficient but not necessary condition being:

$$2k < \sum_{i=1}^{p} |x_i(n)|^2.$$

The summer 38 produces the sum of the signals y(n+1) and $W_m(n+1)x_m(n+1)$ to produce the required residual e(n+1). The FIG. 2 arrangement then operates recursively on subsequent processor output signals $x_m(n+2)$, y(n+2), $x_m(n+3)$, y(n+3), . . . to produce successive signal amplitude residuals e(n+2), e(n+3) . . . every three cycles.

It will now be proved that e(n) is a signal amplitude residual obtained by minimizing the antenna signals subject to the constraint that the main antenna gain factor $\mu$ remains constant. Let the $n^{th}$ sample of signals from all antennas be represented by vector $\underline{\hat{\phi}}(n)$, ie $$\underline{\hat{\phi}}^T(n)=[\phi_1(n), \phi_2(n), \ldots \phi_{p+1}(n)] \tag{6}$$

and denote the constraint factors (FIG. 1) $C_1$ to $C_p$ by a reduced constraint vector $\underline{C}^T$. Define the reduced vector $$\underline{\phi}^T(n)=[\phi_1(n), \phi_2(n), \ldots \phi_p(n)]$$

to represent the subsidiary antenna signals. Let an $n^{th}$ weight vector $\underline{\hat{W}}(n)$ be defined such that:

$$\underline{\hat{W}}^T(n)=[\underline{W}^T(n), W_{p+1}(n)] \tag{7}$$

where $\underline{W}^T(n)=[W_1(n), W_2(n), \ldots W_p(n)]$, the reduced vector of the $n^{th}$ set of weight factors for subsidiary antenna signals.

Finally, define a (p+1) element constraint vector C such that:

$$\hat{\underline{C}}^T=[\underline{C}^T,1] \tag{8}$$

The final element of any constraint vector may be reduced to unity by division throughout the vector by a scalar, so equation (8) retains generality. The application of the linear constraint is given by the relation:

$$\hat{C}^T\hat{W}(n)=\mu \tag{9}$$

where $\mu$ is the main antenna signal gain factor previously defined.

(Prior art algorithms and processing circuits have dealt only with the much simpler problem which assumes that $\hat{C}^T=[0, 0, \ldots 1]$ and $W_{p+1}(n)=\mu$.)

Equation (9) may be rewritten:

$$\underline{C}^T\underline{W}(n)+W_{p+1}(n)=\mu \tag{10}$$

ie $$W_{p+1}(n)=\mu-\underline{C}^T\underline{W}(n) \tag{11}$$

The $n^{th}$ signal amplitude residual e(n) minimizing the antenna signals subject to constraint equation (9) is defined by:

$$e(n)=\hat{\underline{\phi}}^T(n)\hat{\underline{W}}(n) \tag{12}$$

Substituting in equation (12) for $\hat{\underline{\phi}}^T(n)$ and $\hat{\underline{W}}(n)$:

$$e(n) = [\underline{\phi}^T(n), \phi_{p+1}(n)]\left[\frac{W(n)}{W_{p+1}(n)}\right] \tag{13}$$

$$ie\ e(n) = \underline{\phi}^T(n)W(n) + \phi_{p+1}(n)W_{p+1}(n) \tag{14}$$

Substituting for $W_{p+1}(n)$ from equation (11):

$$e(n)=\underline{\phi}^T(n)W(n)+\phi_{p+1}(n)[\mu-\underline{C}^TW(n)] \tag{15}$$

Now $y(n)=\mu\phi_{p+1}(n)$ from FIG. 1:

$$e(n)=\underline{x}^T(n)W(n)+y(n) \tag{16}$$

where $$\underline{x}^T(n)=\underline{\phi}^T(n)-\underline{\phi}_{p+1}(n)\underline{C}^T \tag{17}$$

Now $\underline{\phi}^T(n)-\phi_{p+1}(n)\underline{C}^T=[[\phi_1(n)-C_1\phi_{p+1}(n)], \ldots [\phi_p(n)-\underline{c}_p\phi_{p+1}(n)]]$. $\therefore \underline{x}^T(n)=[x_1(n), \ldots x_p(n)]$ in FIGS. 1 and 2 and:

$$\underline{x}^T(n)W(n)+y(n)=x_1(n)W_1(n)+\ldots x_p(n)W_p(n)+y(n) \tag{18}$$

Therefore, the right hand side of equation (16) is the output of summer 38. Accordingly, summer 38 produces the amplitude residual e(n) of all antenna signals $\phi_1(n)$ to $\phi_{p+1}(n)$ minimized subject to the equation (9) constraint, minimization being implemented by the Widrow LMS algorithm. Minimized output power $E(n)=-||e(n)||^2$, as mentioned previously. Inter alia, this allows an antenna array gain to be configured such that diffraction nulls appear in the direction of noise sources with constant gain retained in a required look direction. The constraint vector specifies the look direction. This is an important advantage in satellite communications for example.

Figure 3:
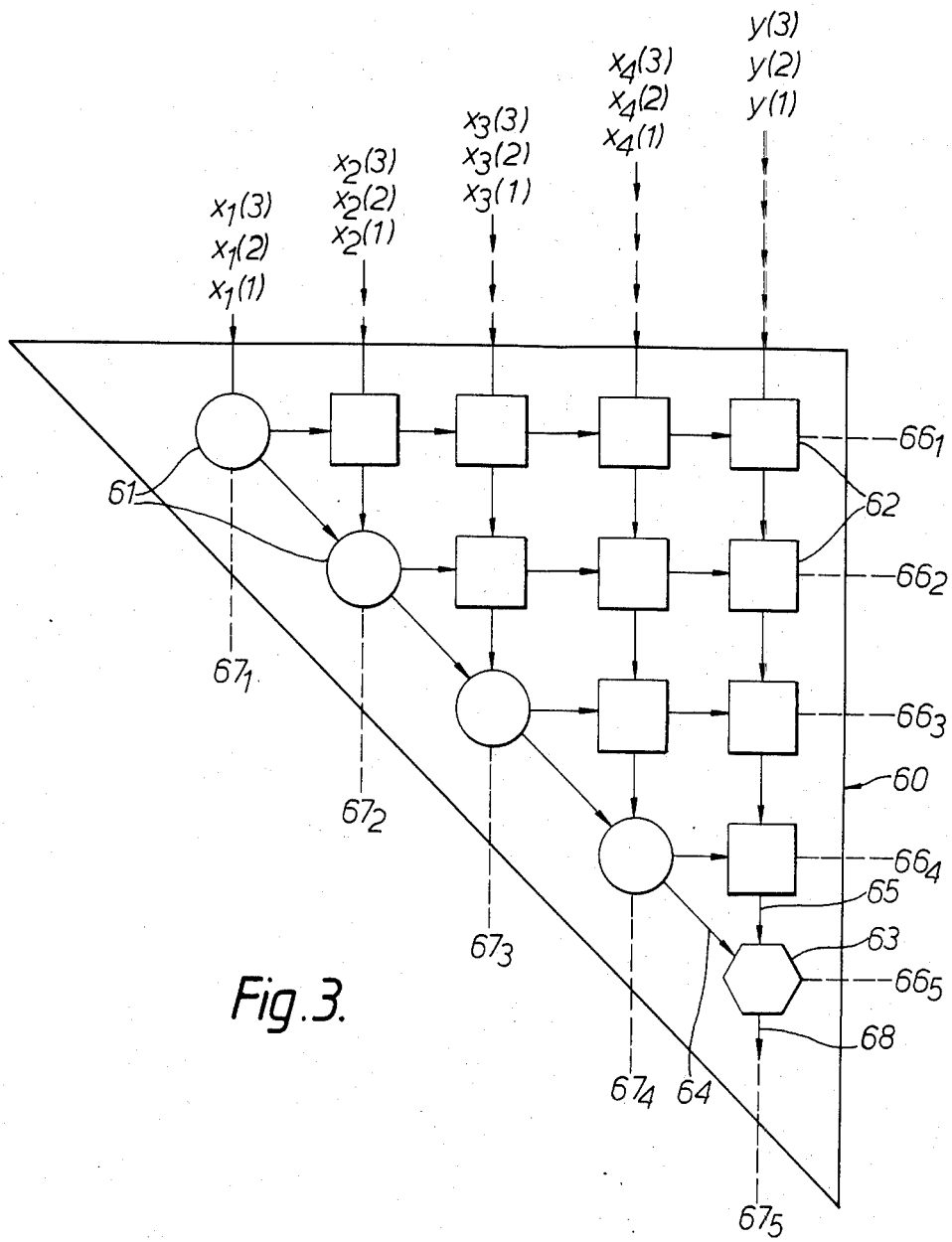
FIG. 3 is a schematic functional drawing of an alternative output processor.

Referring now to FIG. 3, there is shown an alternative form of processor 60 for obtaining the signal amplitude residual e(n) from the output of a constraint application processor of the invention. The processor 60 is a triangular array of boundary cells indicated by circles 61 and internal cells indicated by squares 62, together with a multiplier cell indicated by a hexagon 63. The internal cells 62 are connected to neighbouring internal or boundary cells, and the boundary cells 61 are connected to neighbouring internal and boundary cells. The multiplier 63 receives outputs 64 and 65 from the lowest boundary and internal cells 61 and 62. The processor 60 has five rows $\mathbf{66}_1$ to $\mathbf{66}_5$ and five columns $\mathbf{67}_1$ to $\mathbf{67}_5$ as indicated by chain lines.

The processor 60 operates as follows. Sets of data $x_1(n)$ to $x_4(n)$ and y(n) (where n=1, 2 . . . ) are clocked into the top row $\mathbf{66}_1$ on each clock cycle with a time stagger of one clock cycle between inputs to adjacent rows; ie $x_2(n)$, $x_3(n)$, and y(n) are input with delays of 1, 2, 3 and 4 clock cycles respectively compared to input of $x_1(n)$. Each of the boundary cells 61 evaluates Givens rotation sine and cosine parameters from input data received from above. The Givens rotation algorithm effects a QR composition on the matrix of data elements made up of successive elements of data $x_1(n)$ to $x_4(n)$. The internal cells 62 apply the rotation parameters to the data elements $x_1(n)$ to $x_4(n)$ and y(n).

The boundary cells 61 are diagonally connected together to produce an input 64 to the multiplier 63 consisting of the product of all evaluated Givens rotation cosine parameters. Each evaluated set of sine and cosine parameters is output to the right to the respective neighbouring internal cell 62. The internal cells 62 each receive input data from above, apply rotation parameters thereto, output rotated data to the respective cell 61, 62 or 63 below and pass on rotation parameters to the right. This eventually produces successive outputs at 65 arising from terms y(n) cumulatively rotated by all rotation parameters. The multiplier 63 produces an output at 68 which is the product of all cosine parameters from 64 with the cumulatively rotated terms from 65.

It can be shown that the output of the multiplier 63 is the signal amplitude residual e(n) for the $n^{th}$ set of data entering the processor 60 five clock cycles earlier. Furthermore, the processor 60 operates recursively. Successive updated values e(n), e(n+1) . . . are produced in response to each new set of data passing through it. The construction, mode of operation and theoretical analysis of the processor 60 are described in detail in Applicant's British Patent Application No. 2,151,378A.

Whereas the processor 60 has been shown with five rows and five columns, it may have any number of rows and columns appropriate to the number of signals in each input set. Moreover, the processor 60 may be arranged to operate in accordance with other rotation algorithms, in which case the multiplier 63 might be replaced by an analogous but different device.

Figure 4:
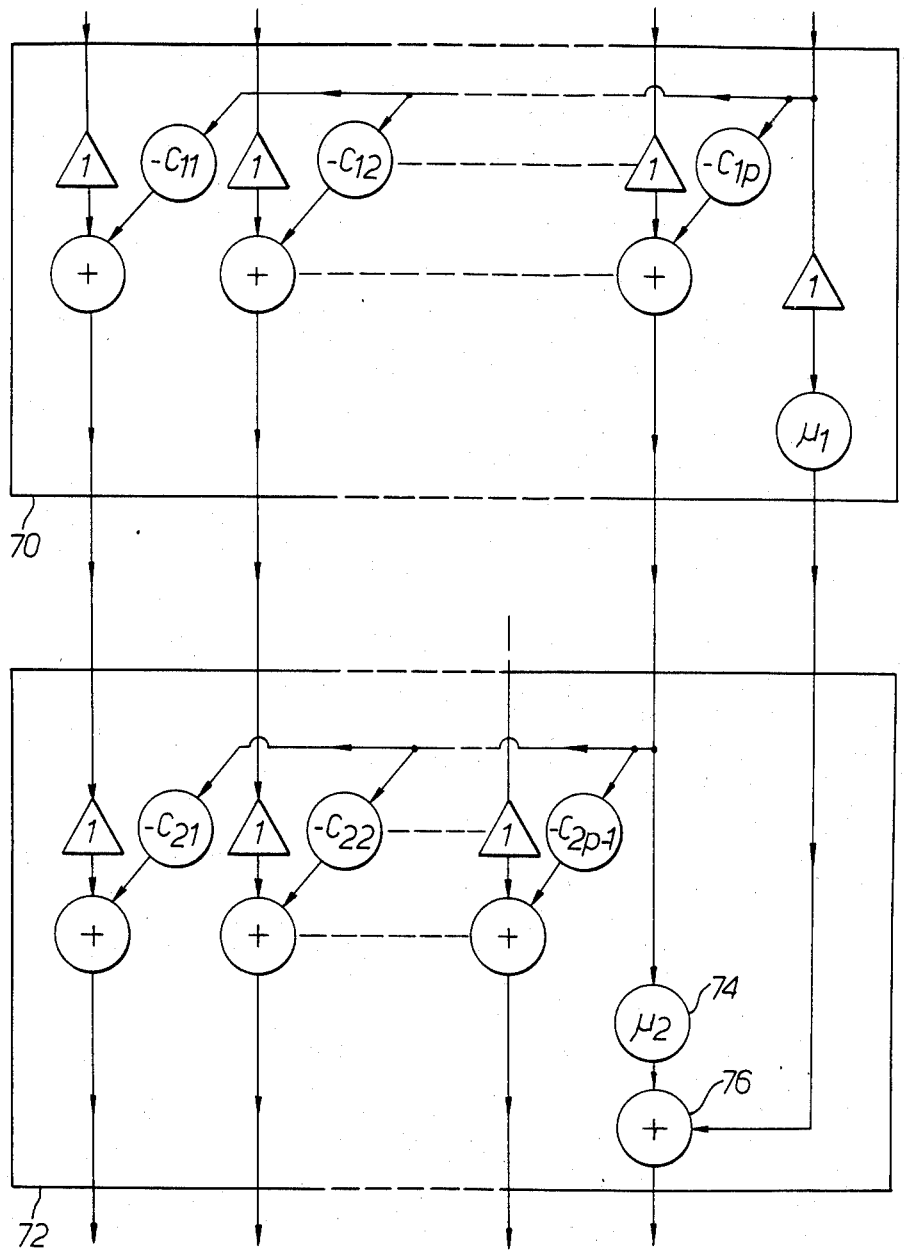
FIG. 4 illustrates two cascaded processors of the invention.

Referring now to FIG. 4, there are shown two cascaded constraint application processors 70 and 71 of the invention arranged to apply two linear constraints to main and subsidiary incoming signals $\phi_1(n)$ to $\phi_{p+1}(n)$. Processor 70 is equivalent to processor 10 of FIG. 1. It applies constraint elements $C_{11}$ to $C_{1p}$ to subsidiary signals $\phi_1(n)$ to $\phi_p(n)$, and a gain factor $\mu_1$ to main signal $\phi_{p+1}(n)$.

Processor 72 applies constraint elements $C_{21}$ to $C_{2(p-1)}$ to the first (p−1) input subsidiary signals, which have become $[\phi_m(n)-C_{1m}\phi_{p+1}(n)]$, where m=1 to (p−1). However, the $p^{th}$ subsidiary signal $[\phi_p(n)-C_{1p}\phi_{p+1}(n)]$ is treated as the new main signal. It is multiplied by a second gain factor $\mu_2$ at 74, and added to the earlier main signal $\mu_1\phi_{p+1}(n)$ at 76. This reduces the number of output signals by one, reflecting the extra constraint or reduction in degrees of freedom. The processor 70 and 72 operate similarly to that shown in FIG. 1, and their construction and mode of operation will not be described in detail.

The new subsidiary output signals $S_m$ become:

$$S_m=[\phi_m(n)-C_{1m}\phi_{p+1}(n)]-C_{2m}[\phi_p(n)-C_{1p}\phi_{p+1}(n)] \quad (18)$$

where m=1 to (p−1).

The new main signal $S_p$ is given by:

$$S_p=\mu_2[\phi_p(n)-C_{1p}\phi_{p+1}(n)]+\mu_1\phi_{p+1}(n) \quad (19)$$

The invention may also be employed to apply multiple constraints.

Additional processors are added to the arrangement of FIG. 4, each being similar to processor 72 but with the number of signal channels reducing by one with each extra processor. The vector relation of equation (9), $\underline{\hat{C}}^T\underline{\hat{W}}(n)=\mu$, becomes the matrix equation:

$$\begin{bmatrix} C_{11} & C_{12} \ldots & C_{1(p-1)} & C_{1p} & 1 \\ C_{21} & C_{22} \ldots & C_{2(p-1)} & 1 & 0 \\ C_{31} & C_{32} \ldots & 1 & 0 & 0 \\ \cdot & \cdot & \cdot & \cdot & \cdot \\ \cdot & \cdot & \cdot & \cdot & \cdot \\ \cdot & \cdot & \cdot & \cdot & \cdot \\ C_{r1} & C_{r2} \ldots & 0 & 0 & 0 \end{bmatrix} W(n) = \begin{bmatrix} \mu_1 \\ \mu_2 \\ \mu_3 \\ \cdot \\ \cdot \\ \cdot \\ \mu_r \end{bmatrix}, \quad (20)$$

ie $\underline{\hat{C}}^T$ has become an rxp upper left triangular matrix C with r<p. Implementation of the rxp matrix C would require one processor 70 and (r−1) processors similar to 72, but with reducing numbers of signal channels. The foregoing constraint vector analysis extends straightforwardly to constraint matrix application.

In general, for sets of linear constraints having equal numbers of elements, triangularization as required in equation (20) may be carried out by standard mathematical techniques such as Gaussian elimination or QR decomposition. Each equation in the triangular system is then normalized by division by a respective scalar to ensure that the last non-zero element or coefficient is unity.

I claim:

1. A constraint application processor including:

input means adapted for receiving a main input signal and a plurality of subsidiary input signals;

means for (a) multiplying said main input signal by a plurality of constraint coefficients to provide a plurality of constraint values, said plurality of constraint coefficients corresponding to a constraint vector having coefficients not all of which are equal, and (b) subtracting respective ones of said plurality of constraint values from corresponding ones of said subsidiary input signals to provide a plurality of subsidiary output signals; and means for applying a gain factor to the main input signal to provide a main output signal.

2. A constraint application processor according to claim 1 further including an output processor for processing said main and said subsidiary output signals to extract a signal residual corresponding to minimization of a sum of said main output signal with a weighted sum of said subsidiary output signals subject to the proviso that the main signal gain factor remains constant.

3. A constraint application processor according to claim 2 wherein the output processor is arranged to operate in accordance with the Widrow Least Mean Square algorithm.

4. A constraint application processor according to claim 2 wherein the output processor includes weighting means for weighting successive sets of subsidiary output signals recursively with respective sets of weight factors.

5. A constraint application processor according to claim 4 wherein the weighting means includes means for multiplying subsidiary output signals by a preceding signal residual and a convergence constant to produce respective weight correction factors, and means for adding the weight correction factors to preceding weight factors to produce respective updated weight factors.

6. A constraint application processor according to claim 1 further including an output processor coupled to receive said main and subsidiary output signals, said output processor including a systolic array of processing cells arranged to compute rotation parameters from said subsidiary output signals and apply said rotation parameters to said main output signal to produce signal residuals recursively.

7. A constraint application processor according to claim 6 wherein the systolic array includes boundary cells for evaluating rotation parameters, internal cells for applying rotation parameters, and means for deriving a signal residual comprising a product of a cumulatively rotated main output signal with cosine rotation parameters.

8. Constraint application apparatus including a first processor and a second processor, said first processor comprising:

input means adapted for receiving a main input signal and a plurality of subsidiary input signals;

means for (a) multiplying said main input signal by a plurality of constraint coefficients to provide a plurality of constraint values, said plurality of constraint coefficients corresponding to a constraint vector having coefficients not all of which are equal, and (b) subtracting respective ones of said plurality of said constraint values from corresponding ones of said subsidiary input signals to provide a plurality of subsidiary output signals; and means for applying a gain factor to the main input signal to provide a main output signal;

said second processor including:

a main input coupled to one of said subsidiary signal outputs of said first processor, for providing a second processor main input signal;

means for (a) multiplying said second processor main input signal by a further plurality of constraint coefficients to provide a further plurality of constraint values, said further plurality of constraint coefficients corresponding to a further constraint vector having coefficients not all of which are equal, and (b) subtracting respective ones of said further plurality of constraint values from corresponding ones of said first processor subsidiary output signals other than said one first processor subsidiary signal output to provide a plurality of second processor subsidiary output signals;

means for applying a second processor gain factor to said second processor main input signal; and means for generating second processor main output signals each comprising a sum of a respecive amplified second processor main input signal and a main first processor output signal.

9. Constraint application apparatus according to claim 8 further including a third processor comprising:

a third processor main input coupled to one of said second processor subsidiary signal outputs for providing third processor main input signals;

means for (a) multiplying one of said third processor main inpu signals by an additional plurality of constraint coefficients to provide a plurality of additional constraint values, said additional plurality of constraint coefficients corresponding to an additional constraint vector having coefficients not all of which are equal, and (b) subtracting respective ones of said additional plurality of constraint values from corresponding ones of said second processor subsidiary signal outputs other than said one second processor subsidiary signal output to provide a plurality of third processor subsidiary output signals;

means for applying a third processor gain factor to said third processor main input signal; and means for generating third processor main output signals each comprising a sum of a respective amplifier third processor main input signal and a main second processor output signal.

* * * * *